US005564824A

United States Patent [19]

Chaplin et al.

[11] Patent Number: 5,564,824

[45] Date of Patent: Oct. 15, 1996

[54] ROTARY VIBRATOR

[75] Inventors: James Chaplin, Racine; Glenn Heimbruch, Franklin, both of Wis.

[73] Assignee: Racine Federated Inc., Racine, Wis.

[21] Appl. No.: 593,108

[22] Filed: Feb. 1, 1996

[51] Int. Cl.[6] ..... B01F 11/00

[52] U.S. Cl. ..... 366/123; 74/87

[58] Field of Search ..... 366/117, 118, 366/120, 121, 122, 123, 124, 125; 74/87

[56] References Cited

U.S. PATENT DOCUMENTS

| | | | |
|---|---|---|---|
| Re. 21,684 | 1/1941 | Mall | 259/1 |
| 2,018,789 | 10/1935 | Jorgensen | 259/72 |
| 2,061,943 | 11/1936 | Jorgensen | 259/1 |
| 2,080,727 | 5/1937 | Ludeman, Jr. | 25/1 |
| 2,148,722 | 2/1939 | Baily | 259/1 |
| 2,178,881 | 11/1939 | Roeth | 259/72 |
| 2,215,888 | 9/1940 | Swarthout | 259/1 |
| 2,236,392 | 3/1941 | Barry et al. | 259/1 |
| 2,492,431 | 12/1949 | Kroeckel | 259/1 |
| 2,705,618 | 4/1955 | Wyzenbeek | 259/1 |
| 2,763,472 | 9/1956 | Fontaine | 259/1 |
| 2,808,238 | 10/1957 | Spitler | 366/123 |
| 3,042,386 | 7/1962 | Wyzenbeek | 259/1 |
| 3,180,625 | 4/1965 | Wyzenbeek | 366/122 |
| 3,202,402 | 8/1965 | Giertz-Hedstrom | 259/1 |
| 3,260,509 | 7/1966 | Rudy et al. | 259/1 |
| 3,410,528 | 11/1968 | Clark | 366/123 |
| 3,784,168 | 1/1974 | Schneider | 366/123 |
| 4,428,678 | 1/1984 | Lyle | 366/124 |
| 4,526,049 | 7/1985 | Pöttgens | 74/87 |
| 4,682,896 | 7/1987 | Halilovi | 366/120 |
| 5,108,189 | 4/1992 | Oswald | 366/123 |

*Primary Examiner*—Robert W. Jenkins

*Attorney, Agent, or Firm*—Wood, Phillips, VanSanten, Clark & Mortimer

[57] ABSTRACT

A vibrator for use in concrete or other semi-fluid or viscous material is provided with a casing having an open chamber therein, a cap detachably connected to the casing, a cantilevered stub shaft extended into the chamber from the cap, a bearing on the stub shaft, and an eccentric weight mounted on the bearing for rotation about an axis and the stub shaft for generating vibrations.

20 Claims, 2 Drawing Sheets

ROTARY VIBRATOR

FIELD OF THE INVENTION

This invention relates to rotary vibrators, and more particularly, to rotary vibrators for use with concrete or other semi-fluid or viscous materials.

BACKGROUND OF THE INVENTION

The use of rotary immersion vibrators to compact unset concrete has long been known. Typically, such vibrators are immersed into concrete which has been poured into forms to build sidewalks, patios, roads, ramps, bridges and the like, so that the concrete can be vibrated to eliminate voids and air to avoid the formation of undesirable pockets or honeycombs, thereby increasing the structural strength of the concrete.

It is common for such vibrators to have a generally tube shaped housing enclosing a rotating eccentric weight that is driven by a flexible shaft or a hydraulic motor to generate vibrations. It is also common for the rotating eccentric weight to be straddle-mounted by rolling element bearings located at either end of the eccentric weight to transfer the oscillating radial loads from the eccentric weight to the tubular housing.

Typically, due to the relatively large radial loads generated by the rotating eccentric weight, the largest possible frame size for the bearings is used within the limited envelope provided by the tubular housing of the rotary vibrator.

Bearing failure is a problem frequently encountered in such vibrators due to the large per bearing operating loads which must be carried by the bearings at either end of the eccentric weight and due to the vibrator's limited ability to retain adequate lubrication in the bearings. Because of the straddle mounted configuration, the operating loads typically must be split between the two bearings at either end of the eccentric weight. Adding additional bearings at either end of the eccentric weight undesirably increases the length of the vibrator and has only a limited effect on the per bearing operating load due to the deflections of the eccentric weight at the bearing mount locations. Additionally, the straddle mounted configuration does not lend itself to retention of lubrication within the bearings because a seal is required on both sides of each bearing location at either end of the eccentric weight, resulting in four rotating seals.

Whenever a bearing fails, the vibrator and its associated equipment must be shut down and the vibrator must be extracted from the concrete and disassembled so that the bearing may be replaced. Commonly, the bearings, the eccentric weight, and the other elements of the rotary vibrator are stacked within the housing as separate components which, in many cases, must be extracted from the tubular housing one component at a time. This operation is not only time consuming, but introduces the risk that individual components may inadvertently fall from the tubular housing and become lost or damaged. After the bearing has been replaced, the vibrator must be reassembled and reinserted into the concrete for operation. Bearing failures have become increasingly problematic as the industry moves toward using dryer mixes of concrete to achieve higher structural strength. Dryer mix concrete requires higher vibratory forces in order to be adequately compacted. Thus, rotary vibrators are increasingly operated so as to achieve these higher vibratory forces, thereby resulting in an increased number of bearing failures.

There is a need for a new and effective rotary vibrator having an eccentric weight mount configuration which minimizes the per bearing operating loads, maintains adequate lubrication within the bearing to prevent untimely bearing failure, and provides for easy and quick bearing replacement when bearing failure occurs.

SUMMARY OF THE INVENTION

In accordance with the present invention, a rotary vibrator is provided wherein an eccentric weight is mounted on bearings to a cantilevered stub shaft extending from a cap which is detachably connected to a casing for ease of bearing replacement.

According to the present invention, a vibrator for use in concrete or other semi-fluid or viscous material is provided with a casing having an open chamber therein, a cap detachably connected to the casing, a cantilevered stub shaft extended into the chamber from the cap and defining an axis, a bearing on the stub shaft, and an eccentric weight mounted on the bearing for rotation about the axis and the stub shaft for generating vibrations.

In a preferred embodiment, the eccentric weight has an interior surface defining a bearing bore therein which receives the bearing and the stub shaft. The eccentric weight has a mass section extending along the axis, eccentric to the axis for generating vibrations. The bearing bore extends the length of the mass section whereby the bearing provides support directly under the mass section.

One feature is the provision of a seal mounted between the stub-shaft and the eccentric weight for retaining a lubricant within the bearing bore.

As another feature, the bearing includes a thrust bearing mounted between the eccentric weight and a terminal end of the stub-shaft for transferring axial loads between the eccentric weight and the stub-shaft.

As another feature, the casing has a first end connected to a power source for powering the vibrator. A removable subassembly extends into the open chamber of the casing and is adapted to be removed from the vibrator while the first end of the casing remains connected to a power source. The subassembly includes a shaft extending into the chamber and defining an axis, a bearing on the shaft, and an eccentric weight mounted on the bearing for rotation about the axis and the stub shaft for generating vibrations.

As yet another feature, the bearing includes a needle roller bearing extending along the axis for transferring radial loads between the eccentric weight and the stub-shaft.

The present invention provides a rotary vibrator having an eccentric weight mount configuration with bearings which are quickly and easily replaced whenever a bearing failure should occur. Further, the present invention provides a rotary vibrator having an eccentric weight mount configuration which retains adequate lubrication within the bearings to maintain bearing life. Additionally, the present invention provides a rotary vibrator having an eccentric weight mount configuration which minimizes the per bearing operating loads with little or no impact on the overall size of the rotary vibrator.

Other objectives, features, and advantages of the invention will be apparent from the following detailed description taken in conjunction with the accompanying drawing.

BRIEF DESCRIPTION OF THE DRAWINGS

The features of this invention which are believed to be novel are set forth with particularity in the appended claims.

The invention, together with its objectives and advantages thereof, may best be understood by reference to the following description taken in conjunction with the accompanying drawing, in which like reference numerals identify like elements and in which.

DETAILED DESCRIPTION OF THE PREFERRED EMBODIMENT

Figure 1:
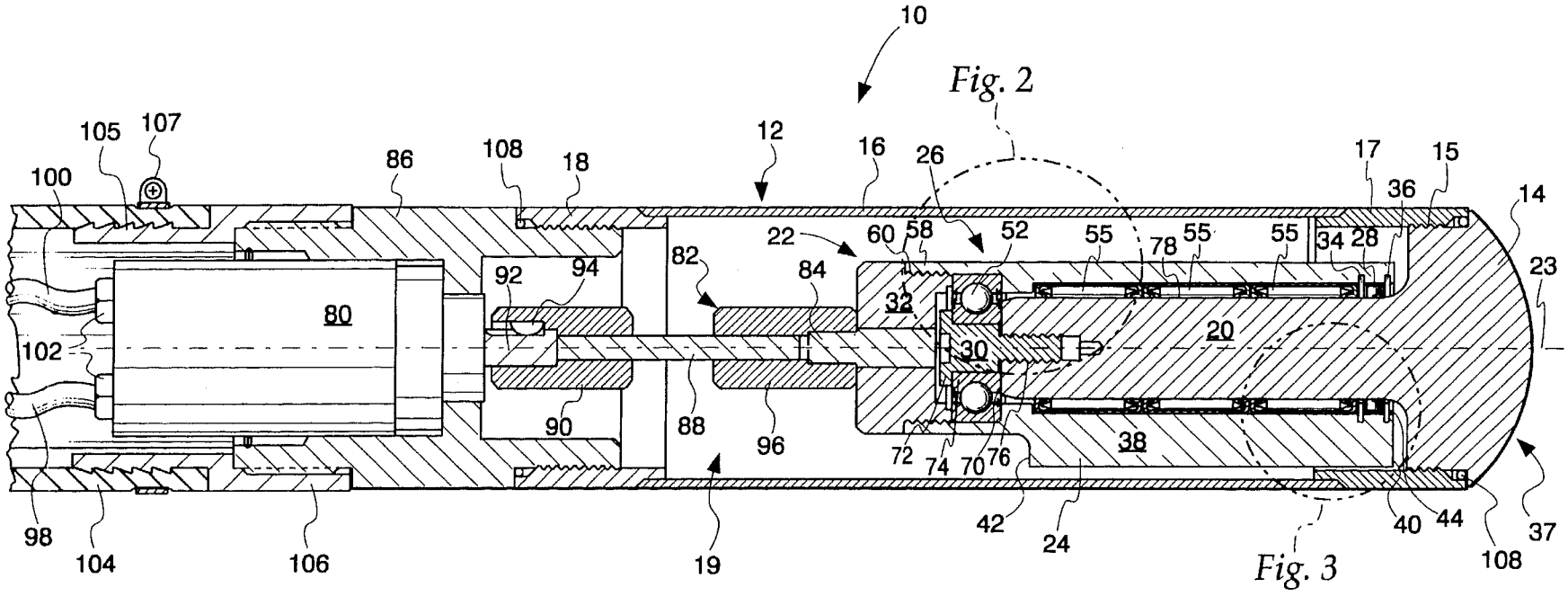
FIG. 1 is a longitudinal sectional view of a rotary vibrator embodying the present invention.

A rotary vibrator 10, as seen in FIG. 1, has an exterior defined by a tubular housing or casing 12 and a cap 14 which is detachably connected to the casing 12 by mating threads 15. The casing 12 is formed from a metal tube 16 and two flanges 17 and 18, with the flanges 17 and 18 welded to opposite ends of the metal tube 16. The casing 12, as well as the components 16, 17 and 18, could also be machined from solid bar of an appropriate cross section. The casing 12 has an open chamber 19 and the cap 14 has a cantilevered stub-shaft 20 which extends from the cap 14 into the chamber 19.

A rotating assembly 22 is mounted on the stub-shaft 20 for rotation about an axis 23 and includes an eccentric weight 24, a bearing assembly 26, a conventional lip seal 28 adjacent the base of the stub-shaft 20, a bearing retainer 30 adjacent the end of the stub-shaft 20, plug/bearing retainer 32, a retaining ring 34 for the bearing assembly 26, and a retaining ring 36 for the lip seal 28.

The cap 14 and the rotating assembly 22 may be removed from the casing 12 as a subassembly 37 by simply unscrewing the cap 14 from the casing 12. This feature allows the rotating assembly 22 to be removed from the vibrator 10 in a simple and efficient manner with no need for the time consuming extraction of individual components from the casing. Additionally, because the rotating assembly 22 is maintained as a single subassembly 37 with the cap 14, there is no risk during the removal from the casing that individual component parts will inadvertently fall from the rotary vibrator 10 and become lost or damaged. Further, this feature allows for simplified maintenance because a pre-assembled subassembly 37 can be quickly and easily substituted for the subassembly 37 currently in the vibrator 10. Finally, this feature allows the rotating assembly 22 to be removed from the vibrator 10 without having to disconnect the vibrator 10 from its power source.

Figure 3:
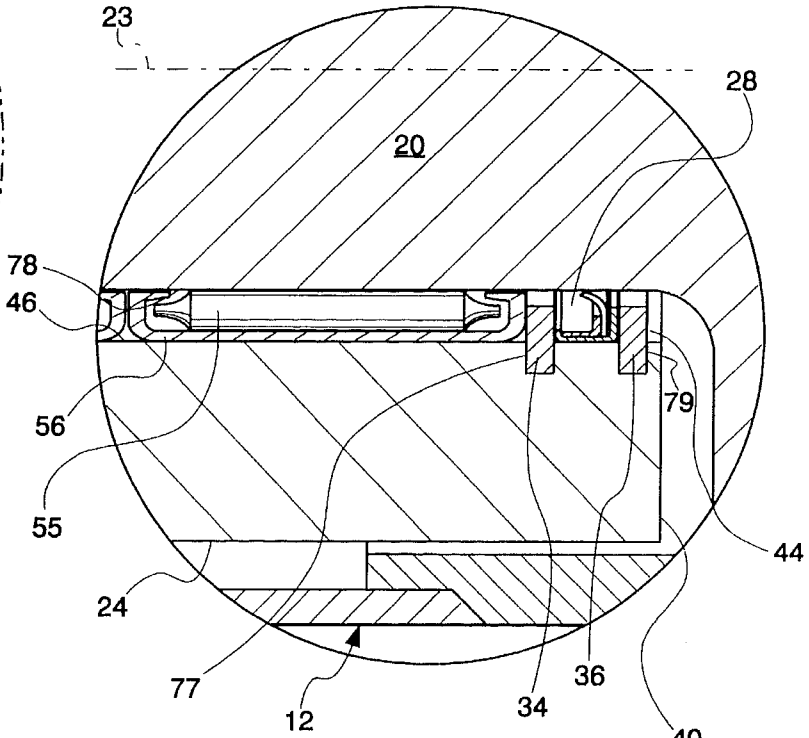
FIG. 3 is an enlarged view of another portion of the rotary vibrator shown in FIG. 1, as indicated by the broken line labelled FIG. 3.
Figure 2:
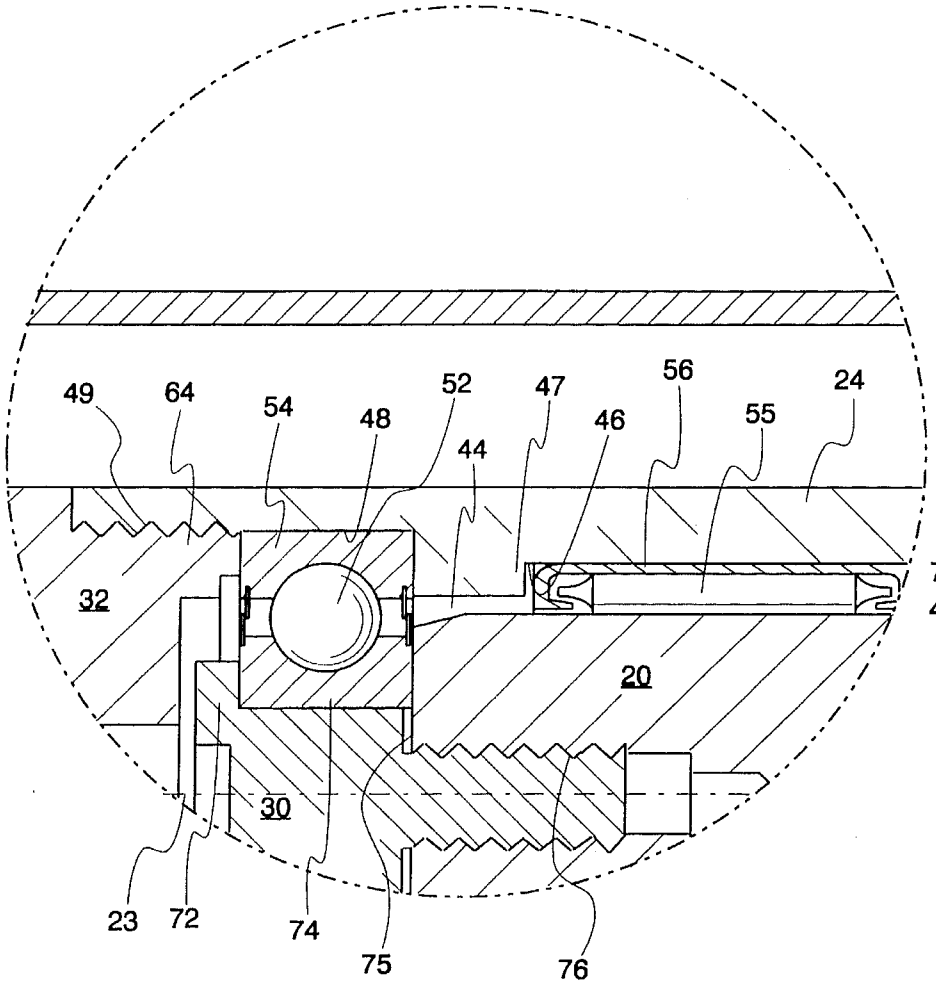
FIG. 2 is an enlarged view of a portion of the rotary vibrator shown in FIG. 1, as indicated by the broken line labelled FIG. 2.

As best seen in FIG. 1, the eccentric weight 24 has a mass section 38 which extends along the axis 23 from a first terminal end 40 to a step 42. As best seen in FIGS. 2 and 3, the eccentric weight 24 is also provided with a bearing bore 44 having a first internal cylindrical surface 46 extending the length of the mass section 38 to an annular rib 47, and a second internal cylindrical surface 48 which extends from the annular rib 47 to an internal thread 49 of the eccentric weight 24.

As best seen in FIG. 2, the bearing assembly 26 includes a sealed or shielded, deep groove ball bearing 52 which acts as a thrust bearing for reacting axial loads. An outer race 54 of the ball bearing 52 is mounted within the second cylindrical surface 48 of the eccentric weight 24. As shown in FIG. 1, the bearing assembly 26 further includes three needle roller bearings 55 which extend along the axis 23 for reacting radial loads. As best seen in FIG. 3, outer races 56 of the bearings 55 are mounted within and press fit against the first cylindrical surface 46 of the eccentric weight 24.

As seen in FIG. 1, the bearing 52 is retained within the bearing bore 44 by the plug/bearing retainer 32 which is detachably connected to a second terminal end 58 of the eccentric weight 24 by mating threads 60. As best seen in FIG. 2, the outer race 54 of the bearing 52 is trapped between the annular rib 47 and a first terminal end 64 of the bearing retainer 32. The bearing 52 is retained to the stub-shaft 20 by the bearing retainer 30 which has a shoulder 72 abutting an inner race 74 of the bearing 52 and forcing the inner race 74 against a terminal end 75 of the stub-shaft 20. The bearing retainer 30 is detachably connected to the stub-shaft 20 by mating threads 76.

The bearings 55 are retained within the bearing bore 44 by the retaining ring 34. As best seen in FIG. 3, the retaining ring 34 is mounted in an annular groove 77 formed in the eccentric weight 24 adjacent the first terminal end 40. The outer races 56 of the bearings 55 are trapped between the retaining ring 34 and the annular rib 47. However, it should be noted that, in some instances, it may be preferable to omit the retaining ring 34 and to use the lip seal 28 for retaining the bearings 55. An outer surface 78 of the stub-shaft 20 acts as the inner race for the bearings 55.

Thus, radial loads generated by the eccentric weight 24 during rotation are reacted directly through the bearings 55 to the outer surface 78 of the stub-shaft 20. Axial loads generated by the rotation of the eccentric weight 24 are reacted against the outer race 54 of the bearing 52 by the annular rib 47 and the first terminal end 64 of the bearing retainer 32. The axial loads are transferred through the bearing 52 to the stub-shaft 20 by the inner race 74 which abuts the terminal end 75 of the stub-shaft 20 and by the bearing retainer 30 which abuts the inner race 74 and is threadably connected to the stub-shaft 20.

As best seen in FIG. 3, the lip seal 28 is mounted in the first cylindrical surface 46 adjacent the terminal end 40 for retaining lubricant within the bearing bore 44 and the bearings 55. The lip seal 28 is trapped between the retaining rings 34 and 36. The retaining ring 36 is mounted in an annular groove 79 formed in the eccentric weight 24 adjacent the terminal end 40. Thus, the lip seal 28 and the sealed or shielded bearing 52 retain lubricant within the bearing chamber 44.

As best seen in FIG. 1, the rotating assembly 22 is rotationally driven by a hydraulic motor 80 through a flexible drive shaft 82 that includes a non-circular drive-tang 84 extending into the bearing retainer 32 with an axially sliding fit. The motor 80 is mounted in a fitting 86 which is threadably engaged with the casing 12. The flexible drive shaft 82 includes a flex shaft 88, a coupling 90 crimped to the flex shaft 88 and operably engaged with a drive shaft 92 of the hydraulic motor 80 through a conventional Woodruff key 94, and a coupling 96 that is crimped to the flex shaft 88 and the drive-tang 84. The drive-tang 84 slides freely in the bearing retainer 32 and the coupling 90 slides freely on the shaft 92 along the axis 23 for purposes of assembly. This allows the subassembly 37 to be removed from the rotary vibrator 10 without removing the hydraulic motor 80. The mating threads 60 between the bearing retainer 32 and the eccentric weight 24 are configured such that they tend to engage when the eccentric weight 24 is driven by the flexible shaft 82.

The hydraulic motor 80 is connected to a hydraulic power source by hydraulic supply and return lines 98 and 100 which are connected to the hydraulic motor 80 by hydraulic fittings 102. The hydraulic lines 98 and 100 are surrounded by a sheath or rubber hose 104 which is clamped to a hose barb 105 on a bracket 106 by a hose clamp 107. The bracket 106 is threadably engaged to the hydraulic vibrator 10 through the fitting 86. The sheath 104 serves to protect the hydraulic lines 98 and 100 and to allow manipulation of the rotary vibrator 10 by an operator.

Any suitable power source and drive means can be substituted for the hydraulic power source and hydraulic motor 80. Appropriate power transfer means can also be substituted for the hydraulic supply and return lines 98 and 100, as well as the hydraulic fittings 102. For example, a high cycle electric motor can be substituted for the hydraulic motor 80, with an appropriate electric power source and electrical cables substituted for the hydraulic power source and the hydraulic supply and return lines 98 and 100.

Packings or seals 108 are provided between the fitting 86 and the casing 12 and between the cap 14 and the casing 12 to prevent fluid from entering the vibrator 10 during operation.

In the event of a bearing failure or for routine maintenance, the cap 14 is unthreaded from the casing 12. The cap 14 and the rotating assembly 22 are then removed as the subassembly 37 from the rotary vibrator 10 and a replacement subassembly 37 is installed.

To replace the bearings 52 and 55, the plug/bearing retainer 32 is unthreaded from the eccentric weight 24 and then the bearing retainer 30 is unthreaded from the stub-shaft 20. This frees the rotating assembly 22 from the stub-shaft 20, thereby allowing the rotating assembly 22 to be removed from the stub-shaft 20. The bearings 52 and 55 may then be removed from the eccentric weight 24 and replaced as required. Reassembly of the rotary vibrator 10 is accomplished in reverse order of the steps for disassembly.

Because the cap 14 and the rotating assembly 22 are removable as the subassembly 37 from the terminal end of the vibrator 10, the bearings 52 and 55 can be replaced without disconnecting and the sheath 104 and the hydraulic lines 98 and 100 from the vibrator 10. Additionally, if necessary, subassembly 37 allows the bearings 52 and 55 to be removed from the vibrator 10 while the vibrator 10 remains within the work environment, without the fear of inadvertently dropping loose components. Thus, the bearings 52 and 55 may be quickly and easily replaced whenever bearing failure occurs.

By spacing the needle roller bearings 55 along and directly under the mass section 38, the radial loads generated by the mass section 38 are distributed equally to each bearing 55. This is advantageous because the radial loads can be equally distributed between more than two bearings, thereby minimizing the operating loads on each of the bearings.

Additionally, because the bearings 55 are placed inside the bearing bore 44 of the eccentric weight 24, there is no additional length required for the mounting of the bearings 55. The material removed from the eccentric weight 24 to form the bearing bore 44 has a minimal impact on the magnitude of vibrational forces generated by the rotary vibrator 10 because the mass at the larger diameters has a far greater impact on the magnitude of the vibrational forces. Thus, more of the length of the rotary vibrator 10 can be devoted to the mass section 38 of the eccentric weight 24 when compared to a standard straddle-mounted design, thereby providing a rotary vibrator 10 which can generate higher vibratory forces for a given rotational speed.

Further, because the axial loads are transferred through the ball bearing 52, the bearings 55 do not have to perform double duty and need only transfer radial loads. This allows for the bearings 55 to be roller bearings which typically have a greater dynamic load rating than ball bearings of a comparable frame size. Thus, bearing failures are further reduced when compared to standard straddle mount designs which commonly employ ball bearings at either end of the eccentric weight to transfer both radial and axial loads.

It will be understood that the invention may be embodied in other specific forms without departing from the spirit or central characteristics thereof. The present examples, therefor, are to be considered in all respects as illustrative and not restrictive, and the invention is not to be limited to the details given herein.

We claim:

1. A vibrator for use in concrete or other semi-fluid or viscous materials, the vibrator comprising:

a casing having an open chamber therein;

a cap detachably connected to the casing;

a cantilevered stub shaft extending into the chamber from the cap and defining an axis;

a bearing on the stub shaft; and an eccentric weight mounted on the bearing for rotation about the axis and the stub shaft for generating vibrations.

2. The vibrator of claim i wherein the eccentric weight has an interior surface defining a bearing bore therein which receives the bearing and the stub shaft.

3. The vibrator of claim 2 wherein:

the eccentric weight has a mass section extending along the axis eccentric to the axis for generating vibrations; and the bearing bore extends the length of the mass section whereby the bearing provides support directly under the mass section.

4. The vibrator of claim 2 further comprising a seal mounted between the stub shaft and the eccentric weight for retaining a lubricant within the bearing bore.

5. The vibrator of claim 4 wherein the seal is mounted within the bearing bore.

6. The vibrator of claim 4 wherein the bearing bore has a first end that is closed and a second end defining an opening for receiving the stub shaft, and wherein the seal is mounted within the opening.

7. The vibrator of claim 1 wherein the stub shaft has a terminal end opposite the cap and wherein the bearing includes a thrust bearing mounted between the terminal end and the eccentric weight for transferring axial loads between the eccentric weight and the stub shaft.

8. The vibrator of claim 1 wherein the bearing includes a needle roller bearing extending along the axis for transferring radial loads between the eccentric weight and the stub shaft.

9. The vibrator of claim 1 wherein the cap and the casing have mating threads formed therein which detachably connect the cap to the casing.

10. A vibrator for use in concrete or other semi-fluid or viscous materials, the vibrator comprising:

a casing having an open chamber therein;

a cantilevered stub shaft attached to the casing extending into the open chamber and defining an axis;

a bearing on the stub shaft;

an eccentric weight mounted on the bearing for rotation about the axis and the stub shaft for generating vibrations, the eccentric weight having an interior surface defining a bearing bore therein which receives the bearing and the stub shaft; and a seal between the stub shaft and the eccentric weight for retaining a lubricant within the bearing bore.

11. The vibrator of claim 10 wherein the seal is mounted within the bearing bore.

12. The vibrator of claim 10 wherein the bearing bore has a first end that is closed and a second end defining an opening for receiving the stub shaft, and wherein the seal is mounted within the opening.

13. A vibrator for use in concrete or other semi-fluid or viscous materials, the vibrator comprising:

a casing having an open chamber formed therein;

a cantilevered stub shaft attached to the casing extending into the open chamber and defining an axis, the stub shaft having a terminal end;

an eccentric weight rotatable on the stub shaft about the axis for generating vibrations; and a thrust bearing mounted between the terminal end and the eccentric weight for transferring axial loads between the eccentric weight and the stub shaft.

14. The vibrator of claim 13 further comprising a needle roller bearing between the stub shaft and the eccentric weight and extending along the axis for transferring radial loads between the eccentric weight and the stub shaft.

15. The vibrator of claim 13 further comprising a bearing retainer detachably connected to the stub shaft adjacent the terminal end; and wherein the thrust bearing has a race that is captured between the terminal end and the bearing retainer.

16. The vibrator of claim 13 further comprising:

a bearing retainer detachably connected to an open end of the eccentric weight; and wherein the thrust bearing has a race captured between the eccentric weight and the bearing retainer.

17. The vibrator of claim 13 further comprising a first bearing retainer detachably connected to the stud shaft adjacent the terminal end;

a second bearing retainer detachably connected to the eccentric weight adjacent the terminal end; and wherein the thrust bearing is a ball bearing having an inner race and an outer race, the inner race being captured between the first bearing retainer and the terminal end, and the outer race being captured between the second bearing retainer and the eccentric weight.

18. A vibrator for use in concrete or other semi-fluid or viscous materials, the vibrator comprising:

a casing having an open chamber and a first end, the first end connected to a power source for powering the vibrator; and a removable subassembly extending into the open chamber and adapted to be removed from the casing while the first end of the casing remains connected to the power source, the subassembly having a shaft extending into the chamber and defining an axis, a bearing on the shaft, and an eccentric weight rotatable on the bearing about the axis for generating vibrations.

19. The vibrator of claim 18 wherein the subassembly further includes a cap detachably connecting the subassembly to the casing and wherein the shaft extends from the cap.

20. The vibrator of claim 18 wherein a slip coupling engages the subassembly with the power source for rotatably driving the eccentric weight.

* * * * *